US012790834B2

(12) United States Patent
Wang

(10) Patent No.: US 12,790,834 B2
(45) Date of Patent: Nov. 10, 2026

(54) WINDOW CORNER GUARD AND WINDOW CORNER PROTECTION METHOD

(71) Applicant: Ningbo Eudemon Child Protective Equipment Co., Ltd., Ningbo (CN)

(72) Inventor: Jinguo Wang, Zhejiang (CN)

(73) Assignee: Ningbo Eudemon Child Protective Equipment Co., Ltd., Ningbo (CN)

( * ) Notice: Subject to any disclaimer, the term of this patent is extended or adjusted under 35 U.S.C. 154(b) by 18 days.

(21) Appl. No.: 18/957,474

(22) Filed: Nov. 22, 2024

(65) Prior Publication Data

US 2025/0084650 A1 Mar. 13, 2025

(30) Foreign Application Priority Data

Feb. 2, 2024 (CN) ..... 202420266836.5

(51) Int. Cl.
*E04F 19/02* (2006.01)

(52) U.S. Cl.
CPC ..... *E04F 19/028* (2013.01)

(58) Field of Classification Search
CPC ..... E04F 19/028
USPC ..... 52/288.1, 287.1, 272, 312; 248/345.1
See application file for complete search history.

(56) References Cited

U.S. PATENT DOCUMENTS

| | | | | |
|---|---|---|---|---|
| 6,354,049 | B1 * | 3/2002 | Bennett | E04F 19/028 52/287.1 |
| 6,484,472 | B2 * | 11/2002 | Chi | E04F 19/028 52/312 |
| 2001/0037617 | A1 * | 11/2001 | Chi | E04F 19/028 52/312 |
| 2005/0055914 | A1 * | 3/2005 | Gilstrap | E04B 1/66 52/272 |
| 2006/0046021 | A1 | 3/2006 | Morris | |
| 2006/0277853 | A1 | 12/2006 | Dillon | |

* cited by examiner

*Primary Examiner* — Todd M Epps

(57) ABSTRACT

The invention discloses a window corner guard and a window corner protection method. The window corner guard includes a base, a corner guard and a rotary locking assembly, where the rotary locking assembly can lock or unlock the corner guard, in a locked state, the corner guard is locked in a state of protecting a window corner, and in an unlocked state, the corner guard rotates to allow a window sash to be normally closed. The window corner guard is capable of being kept locked to protect the window corner to prevent children from impact injuries when the window sash is opened, and improve safety.

15 Claims, 4 Drawing Sheets

WINDOW CORNER GUARD AND WINDOW CORNER PROTECTION METHOD

TECHNICAL FIELD

The present invention belongs the field of household protection articles, and specifically relates to a window corner guard capable of protecting a window corner to prevent impact injuries and a window corner protection method.

BACKGROUND

Casement windows are normally open windows, and are typically mounted to window frames at left or right sides or top ends of window sashes by hinges. For inward-opening casement windows, after the window sashes are opened, sharp window corners may cause injuries when people impact, especially for children with strong curiosity and immature minds, the risk of injury is higher.

Therefore, it is necessary to develop protective devices to protect the window corners and avoid personal injury.

For example, Chinese utility model patent No. CN209976406U discloses a window corner protection device which has a mounting plate, a connecting structure and a flexible anti-impact body, where in use, the connecting structure and the flexible anti-impact body are rotatably arranged relative to the mounting plate under the action of a rotating shaft to protect a window corner or allow a window sash to be closed. As another example, Chinese utility model patent No. CN206592045U discloses a window corner anti-impact device which is composed of a fan-shaped soft rubber material to completely protect a window corner after mounting. As another example, Chinese utility model patent No. CN209637572U discloses a window anti-impact corner which has an elastic telescopic wall to connect between an inner protective wall and an outer protective wall, thus realizing covering and protection of window corners with different thicknesses.

However, these protective devices do not have a locking function, and children may operate them during play, leaving the window corners exposed, which may lead to impact injuries in certain cases.

SUMMARY

It is an object of the present invention to provide a window corner guard capable of locking a guard in a locked state to prevent a window corner from being exposed and causing impact injury due to unauthorized operation of a child to improve safety, and a window corner protection method.

As a first aspect of the present invention, there is provided a window corner guard, including:

a base configured to be fixed to the window sash;

a corner guard configured to protect the window corner, the corner guard being rotatably connected to the base about a pivot as a pivot axis; and a rotary locking assembly including a first locking member and a second locking member respectively provided on the base and the corner guard, the first locking member being engaged with or disengaged from the second locking member to form a locked state or an unlocked state; in the locked state, rotation of the corner guard relative to the base is locked to maintain the corner guard in a state of protecting the window corner; and in the unlocked state, the corner guard is rotatable relative to the base to release the protection of the window corner and allow the window sash to be closed.

With regard to the window corner guard of the technical solution, adding the rotary locking assembly can prevent the window corner guard from being disengaged from the window corner due to closing the window or operating the corner guard, thus improving protection safety.

According to the window corner guard described above, where: the base and the corner guard are respectively provided with a shaft hole and a shaft column, and the shaft column is fitted in the shaft hole so that the corner guard is rotatably connected to the base; the shaft hole extends in a direction perpendicular to a length thereof to form a shaft hole in elongated shape, and a first pivot position and a second pivot position are formed in the shaft hole; the base and the corner guard are respectively provided with a first limiting member and a second limiting member; when the shaft column is in the first pivot position, the first limiting member is engaged with a second limiting member to lock the rotation of the corner guard relative to the base; when the corner guard slides so that the shaft column is in a second pivot position, the first limiting member is disengaged from the second limiting member to release locking and allow the corner guard to rotate, so that the first limiting member, the second limiting member, the shaft hole in elongated shape and the shaft column together form the locking assembly, and the shaft hole and the shaft column also form a pivotal connection structure between the corner guard and the base.

As a second aspect of the present invention, there is provided a window corner protection method for protecting a window corner of a window sash to prevent impact injury, including:

providing a window corner guard including a base and a corner guard; one of a shaft column and a shaft hole being provided on the base, the other being provided on the corner guard, and the shaft column being arranged in the shaft hole in a penetrating manner; a size of the shaft hole in a first direction perpendicular to a length direction of the shaft column being greater than a size of the shaft column, and a first pivot position and a second pivot position arranged at a predetermined distance apart being formed in the first direction; and a rotary locking assembly acting between the base and the corner guard to lock or unlock rotation of the corner guard;

fixing the base to a surface of the window sash near the window corner;

to protect the window corner, rotating the corner guard to cover the window corner, and then displacing the corner guard in the first direction to displace the shaft column to the first pivot position, and the rotary locking assembly locking the rotation of the corner guard to be kept locked; and to release the protection, reversely displacing the corner guard in the first direction to displace the shaft column from the first pivot position to the second pivot position, unlocking the rotary locking assembly, and restoring the corner guard to be rotatable to form an unlocked state.

As a third aspect of the present invention, there is provided a window corner guard configured to be mounted to a window corner of a window sash to prevent impact injuries, including:

a base configured to be fixed to the window sash near the window corner; and a corner guard capable of covering the window corner and being locked for rotation by a rotary locking assembly to prevent impact injuries, and also capable of unlocking the rotary locking assembly to transition to a freely rotatable state.

The corner guard is pivotably connected to the base by a shaft column, and is formed with a first pivot position and a second pivot position, the corner guard is also movably displaced relative to the base along a first direction perpendicular to a direction in which the shaft column extends, and the second pivot position is spaced apart by a predetermined distance in the first direction relative to the first pivot position.

When the shaft column is in the first pivot position, the rotary locking assembly locks the rotation of the corner guard to form a locked state. The corner guard is driven to movably displace in the first direction so that the shaft column is displaced from the first pivot position to the second pivot position, and the rotary locking assembly is unlocked to transition to the freely rotatable unlocked state.

As a fourth aspect of the present invention, there is provided a window corner protection method for protecting a window corner of a window sash to prevent impact injuries, including:

providing a window corner guard which is fixed to the window sash near the window corner, can be locked in a locked state of covering the window corner to protect the window corner when the window sash is open, and can be transitioned to a freely rotatable unlocked state to allow the window sash to be closed, where the window corner guard includes a base and a corner guard;

to protect the window corner, rotating the corner guard to cover the window corner, and locking rotation of the corner guard by a rotary locking assembly to keep the corner guard in a locked state; and to release the protection, driving the corner guard to be displaced in a first direction away from the base, so that the rotary locking assembly unlocks and allows the corner guard to restore the corner guard to a freely rotatable unlocked state.

The window corner guard of the present invention has the following beneficial effects.

1. The window corner guard has a rotary locking function, which can prevent the sharp window corner from being exposed and causing impact injuries due to disengagement of the corner guard from the window corner caused by child operation, and the corner guard can be driven to rotate to be disengage from the window corner only after being manually operated to unlock, thus improving safety.
2. In some embodiments, the corner guard is slidably movable in addition to being rotatably arranged relative to the base to lock or unlock its rotation function by sliding of the corner guard, which is convenient in operation and also improves user experience.
3. In some embodiments, the sliding movement of the corner guard is also locked by a key which can be pressed for unlocking, and then slid to unlock the rotation, and such an operation mode can reduce the possibility of child operation and improve the safety. In addition, the key is wrapped and concealed, which can further improve the safety.

Figure 1:
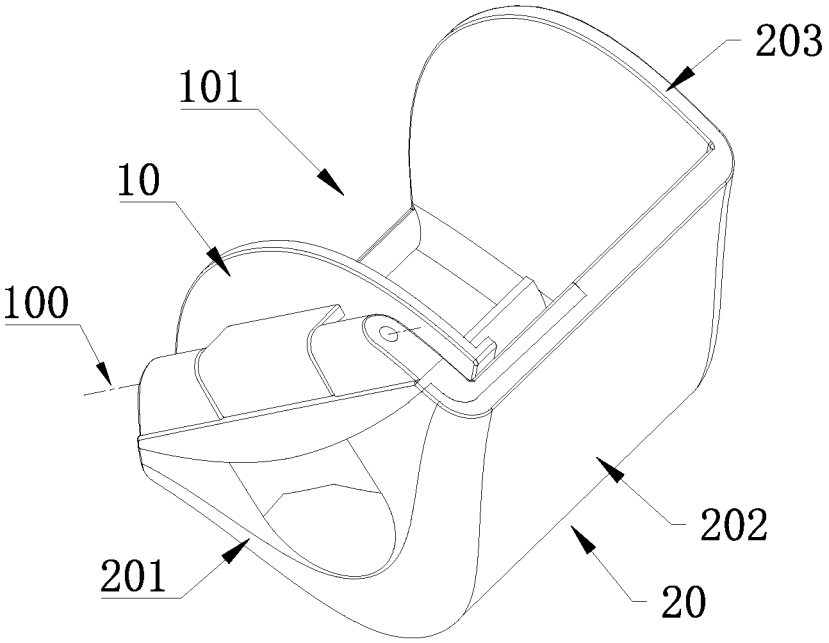
FIG. 1 is a structural schematic diagram of a window corner guard according to Embodiment 1 of the present invention, where the window corner guard is in a locked state.

Reference numerals in the drawings: base 10, corner guard 20, pivot 100, corner protection cavity 101, first pivot position 102, second pivot position 103, first wall member 201, second wall member 202, third wall member 203, guide groove 204, key hole 205, second limiting member 206, base body 11, connecting seat 12, connector 21, guard 22, body wall member 111, body projection member 112, key groove 120, shaft hole member 121, guide member 122, first limiting member 123, locking arm 124, limiting wall 125, key 126, limiting clip 127, limiting groove 128, spring seat 129, shaft column 131, shaft hole 132, first sliding block 133, second sliding block 134, shaft column hole 135, first connecting face 211, second connecting face 212, shaft column arm 213, shaft column cavity 214, molding portion 215, first guard 221, second guard 222, third guard 223, molding connecting portion 224, molding connecting groove 225, and operating region 226.

DESCRIPTION OF THE EMBODIMENTS

In order to make those skilled in the art better understand the present invention and thereby define the scope of the present invention more clearly, the present invention is described below in detail with respect to some specific embodiments of the present invention.

A window corner guard, includes:

a base 10 configured to be fixed to the window sash;

a corner guard 20 configured to protect the window corner, where the corner guard 20 is rotatably connected to the base 10 about a pivot 100 as a pivot axis; and a rotary locking assembly including a first locking member and a second locking member respectively provided on the base 10 and the corner guard 20, where the first locking member is engaged with or disengaged from the second locking member to form a locked state or an unlocked state.

In the locked state, rotation of the corner guard 20 relative to the base 10 is locked to maintain the corner guard 20 in a state of protecting the window corner; and in the unlocked state, the corner guard 20 is rotatable relative to the base 10 to release the protection of the window corner, allowing the window sash to be closed.

Embodiment 1

A window corner guard can be fixed to a window sash for use by means of gluing, screw fixing, hot melting and the like. When a window sash is in an open state, the window corner guard can be adjusted to a locking state (or a protected state) to keep a window corner of the window sash protected to prevent children or adults from impacting the window corner and causing injury. When the window sash needs to be closed, the window corner guard can be manually adjusted to an unlocked state to allow the window sash to be normally closed.

As shown in FIGS. 1-6, the window corner guard is composed of a base 10 and a corner guard 20 which are movable relative to each other, where: the base 10 is configured to be fixed to a proper position near the window corner, and the corner guard 20 is pivotally connected to the base 10 to protect the window corner to prevent people from impacting the window corner of the window sash, thus playing a safety protection function, which is especially important for use scenarios with children.

As shown in FIG. 1, the corner guard 20 is rotatably connected to the base 10 about a pivot 100 as a pivot axis thereof, so that the corner guard 20 covers the window corner for protection by rotating the corner guard 20 relative to the base 10, or the corner guard 20 can be rotated relative to the base 10 to disengage from the window corner to achieve the purpose of allowing the window sash to be closed, which avoids the case that the window sash is unable to be normally closed due to the mounting of the corner guard.

In the present embodiment, the window corner guard also has a rotary locking assembly for locking or unlocking the rotation of the corner guard 20 relative to the base 10, thus keeping the corner guard 20 in a protected state or an unlocked state that allows the window sash to be closed. Specifically, the rotary locking assembly is composed of a first locking member provided on the base 10 and a second locking member provided on the corner guard 20, the first locking member and the second locking member are detachably connected, and when they are engaged with each other, the corner guard 20 can be locked and held in place to inhibit its rotation to form the locked state, and when they are disengaged, the corner guard 20 can be allowed to rotate, thus releasing the locking and forming the unlocked state.

In the locked state (or the protected state), the rotation of the corner guard 20 relative to the base 10 is locked, so that the corner guard 20 keeps covering and protecting the window corner to prevent impact injuries.

In the unlocked state, the corner guard 20 is rotatable relative to the base 10 to release the protection of the window corner, allowing the window sash to be closed.

Figure 2:
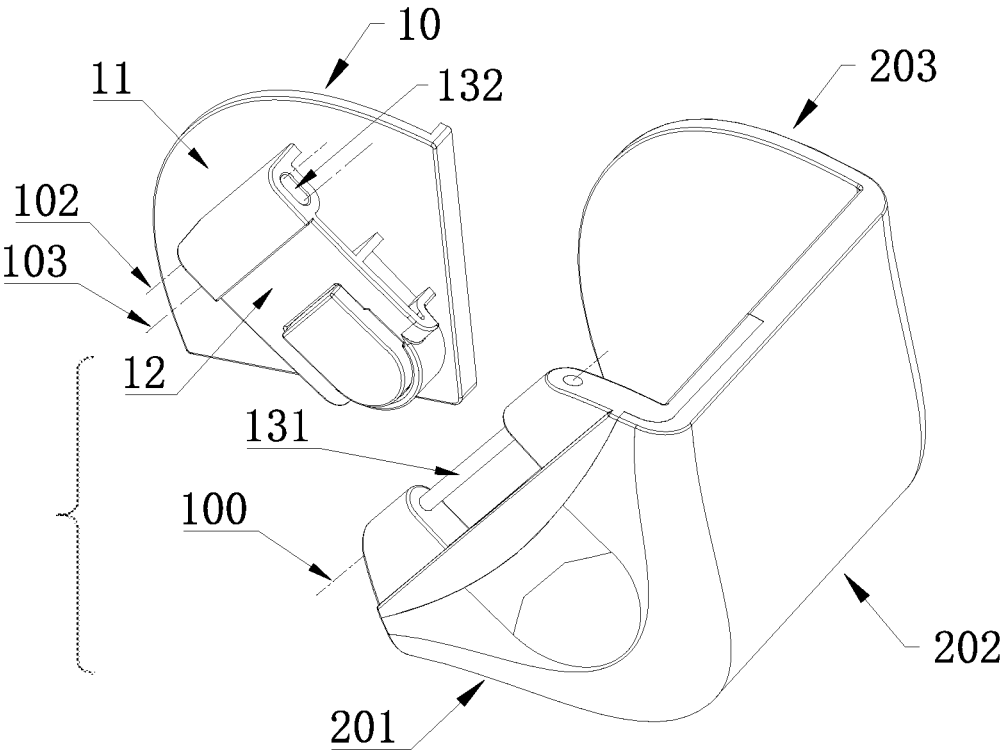
FIG. 2 is a structural exploded view of the embodiment of FIG. 1.

As shown in FIG. 2, the base 10 is provided with a shaft hole 132, and the corner guard 20 is provided with a shaft column 131, the haft column 131 is fitted into the shaft hole 132 in a penetrating manner, so that the corner guard 20 is rotatably connected to the base 10. Furthermore, the shaft hole 132 extends in a direction perpendicular to a length direction thereof (i.e., a first direction) to form a shaft hole in elongated shape, and a first pivot position 102 and a second pivot position 103 are thus respectively formed at both ends of the shaft hole 132, so that the shaft hole 132 is formed as a shaft hole with an elongated cross-sectional shape (taking a cross-section along a plane perpendicular to the pivot 100). In the present embodiment, the cross-sectional shape of the shaft hole 132 is a running track shape, so that the first pivot position 102 and the second pivot position 103 are formed at both ends of the shaft hole 132 and can form pivotal connection at both ends respectively.

In addition, a first limiting member 123 is further provided on the base 10, a second limiting member 206 is correspondingly provided on the corner guard 20, and when the shaft column 131 is in the first pivot position 102, the first limiting member 123 is engaged with the second limiting member 206 to lock the rotation of the corner guard 20 relative to the base 10; and the first limiting member 123 is disengaged from the second limiting member 206 when the shaft column 131 is in the second pivot position 103, thus releasing the locking and allowing the corner guard 20 to rotate.

In the present embodiment, the first limiting member 123 and the second limiting member 206 are respectively a concave member and a convex member to be engaged for locking or disengaged for unlocking by a concave-convex fit therebetween. In other embodiments, the first limiting member 123 and the second limiting member 206 may be a first magnetic attraction member and a second magnetic attraction member respectively, one of the two magnetic attraction members is a magnet, and the other is a ferromagnetic member or another magnet.

Therefore, in the present embodiment, the rotary locking assembly is formed by the first limiting member 123, the second limiting member 206, the shaft hole 132 in elongated shape, and the shaft column 131.

As shown in FIG. 2, the shaft column 131 is an integral columnar member and arranged in the shaft hole 132 in a penetrating manner. In some other embodiments, the shaft column 131 may be of a split type structure, that is, two columnar portions are respectively fitted at both ends of the shaft hole 132 so that the corner guard 20 is rotatably connected to the base 10.

In the present embodiment, the base 10 of the window corner guard is configured to be fixed to an inner surface of the window sash, so that the base does not have a blocking effect when the window sash is closed. Furthermore, the corner guard 20 of the window corner guard is specifically composed of a first wall member 201, a second wall member 202 and a third wall member 203. In the locked state, the first wall member 201 is located at the inner surface of the window sash, the second wall member 202 is located at a side surface of the window sash (including a bottom edge and a side edge of the window sash), and the third wall member 203 is located at an outer surface of the window sash, thus achieving complete protection of the window corner. A corner protection cavity 101 configured to accommodate the window corner is formed in the window corner guard. A thickness of the corner protection cavity 101 (i.e., a distance between the first wall member 201 and the third wall member 203) is greater than a thickness of the window sash, or the third wall member 203 is made of a soft deformable material, so that the window corner can be accommodated in or removed from the corner protection cavity 101.

Most preferably, the pivot 100 is arranged at a 45° angle relative to a lower edge (i.e., the bottom edge) of the window sash to allow the window corner to be fitted in or removed from the corner protection cavity 101 when the second wall member 202 simultaneously wraps both sides of the window corner. Of course, in other embodiments, the second wall member 202 may wrap only one of the sides of the window sash. For example, the second wall member 202 may be a blocking surface fitted at a lower side edge of the window sash extending to wrap or beyond a boundary between the two sides (i.e., the window corner).

Figure 3:
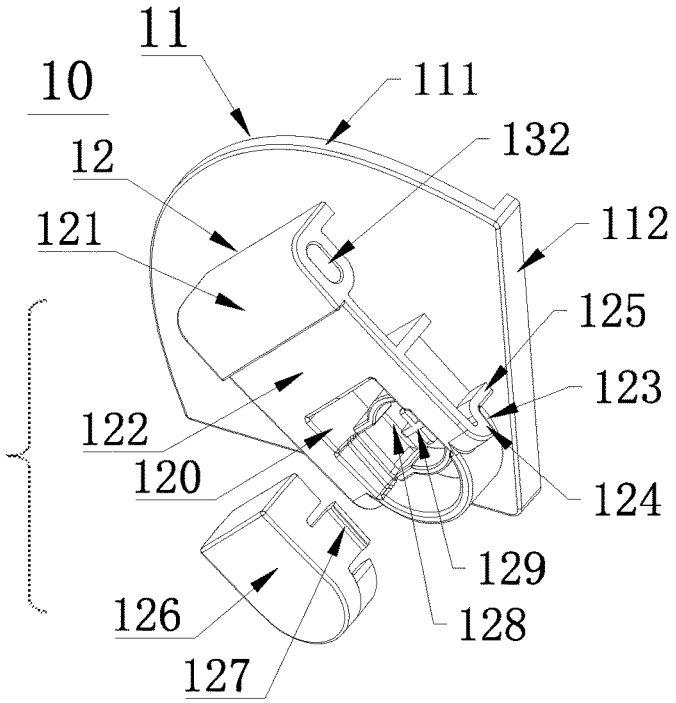
FIG. 3 is a structural schematic diagram of a base in the embodiment of FIG. 1.

As shown in FIGS. 2 and 3, the base 10 is composed of a base body 11 and a connecting seat 12 provided on one side surface of the base body 11, and the connecting seat 12 extends at a 135° angle relative to the bottom edge of the window sash, that is, in a direction perpendicular to the pivot 100. Here, the base body 11 is generally a sheet-like member which includes a body wall member 111 in a planar sheet shape and a body projection member 112 projecting along an edge of the body wall member 111. The body wall member 111 is configured to be fitted onto the surface of the window sash for fixing, and the body projection member 112 is configured to reinforce a structural strength of the base body 11 and to be mounted and positioned when the body wall member 111 is fixed to the surface of the window sash. The connecting seat 12 includes a shaft hole member 121 and a guide member 122. The shaft hole 132 is arranged perpendicular to a length direction of the connecting seat 12 and the shaft hole 132 is located in the shaft hole member 121. A locking arm 124 arranged along the length direction of the connecting seat 12 and a limiting wall 125 arranged perpendicular to the locking arm 124 are provided on two side walls of the guide member 122. The limiting wall 125 is located at an inner end of the locking arm 124, and an outer end of the locking arm 124 is vacant, thus forming the first limiting member 123 in the shape of a strip-shaped groove.

In the present embodiment, displacement movement of the corner guard 20 relative to the base 10 between the first pivot position 102 and the second pivot position 103 is also locked or unlocked by an additional mechanism to allow displacement. As shown in FIG. 3, an outer surface of the guide member 122 is further concavely provided with a key groove 120 for the key 126 to be fitted therein, a spring seat 129 is provided in the key groove 120, one end of a return spring (not shown in the figure) is mounted on the spring seat 129, and the other end thereof abuts against an inner wall of the key 126, a limiting clip 127 is provided on the key 126, a limiting groove 128 is correspondingly provided in the key groove 120, the key 126 is movably arranged in a direction perpendicular to the body wall member 111, and the limiting clip 127 is snapped in the limiting groove 128 to limit a movable stroke of the key 126. When pressed, the key 126 can be displaced inward, and after the external force is removed, the key 126 can be displaced outward under the action of the return spring to reset, so that the key groove 120 can lock and hold the shaft column 131 in the first pivot position 102 or unlock the shaft column to allow the shaft column to displace and move toward the second pivot position 103 by engaging/disengaging the key 126 with/from a key hole 205 of the corner guard 20.

In the present embodiment, an outer surface of the shaft hole member 121 is arranged higher than the outer surface of the guide member 122, so that the shaft hole member 121 is flush with the corner guard 20 after fitting.

Figure 4:
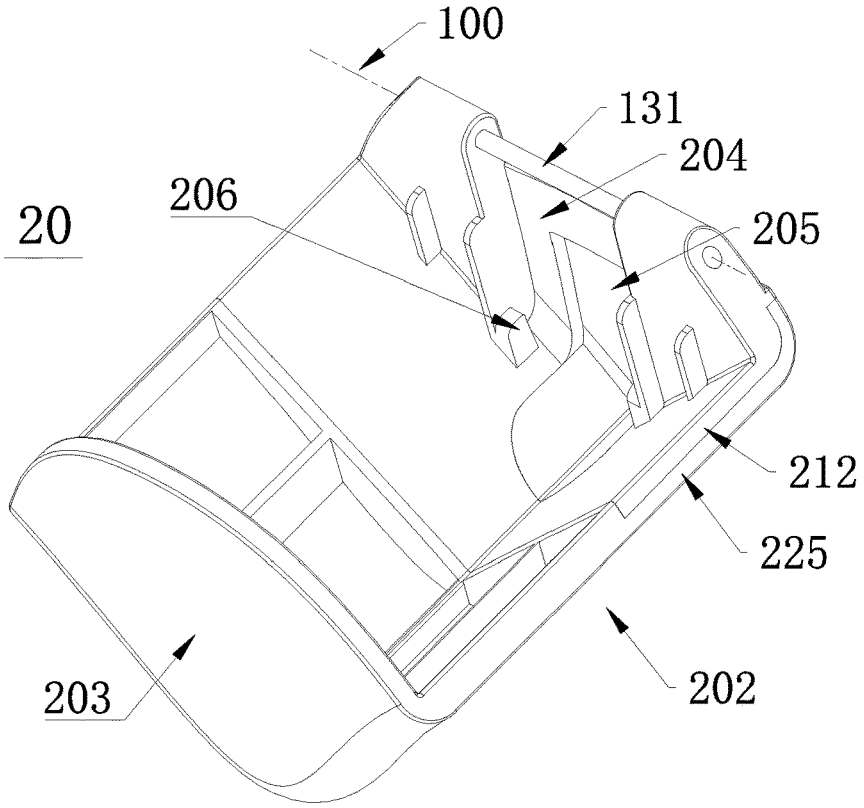
FIG. 4 is a structural schematic diagram of a corner guard in the embodiment of FIG. 1.
Figure 5:
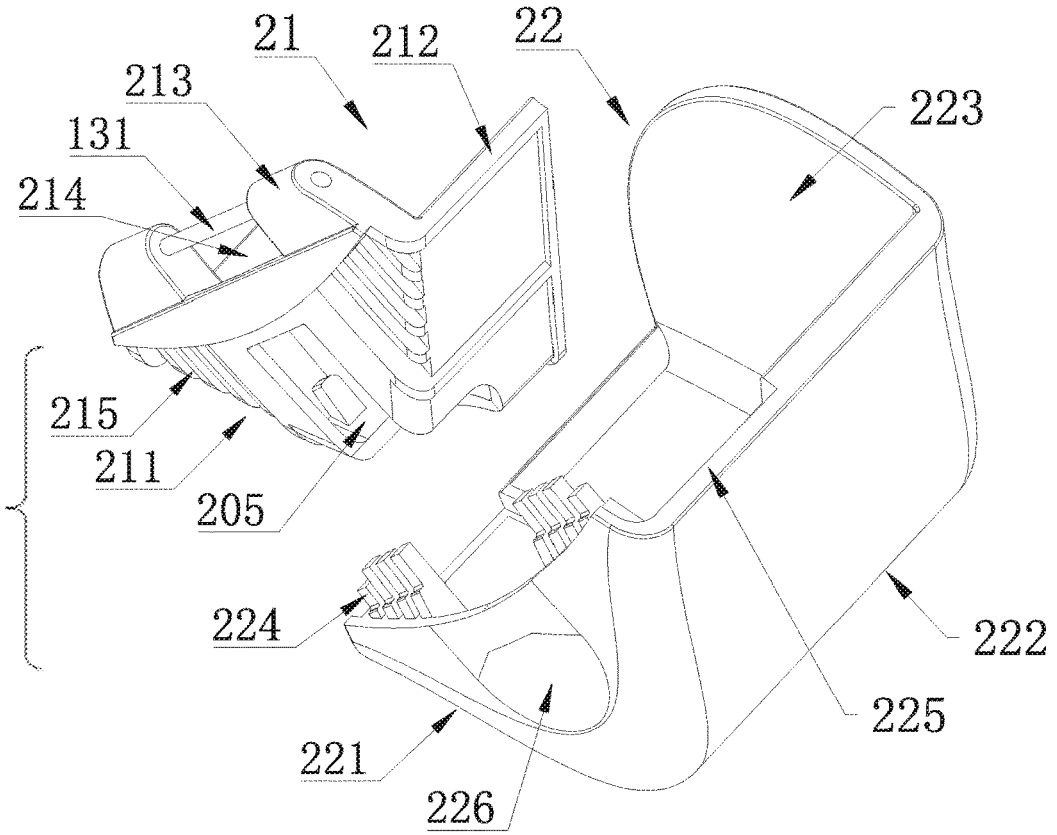
FIG. 5 is a structural exploded view of a corner guard in FIG. 4.

As shown in FIGS. 2, 4 and 5, the corner guard 20 is composed of a connector 21 and a guard 22 fixedly connected with the connector 21, and the shaft column 131 is arranged on the corner guard 20 and extends in a direction at a 45° angle relative to the bottom edge of the window sash. Most preferably, the shaft column 131 is composed of a metal column to have a good strength and is fixed in the corner guard 20. Here, the connector 21 is made of a hard material, such as hard plastic, and the guard 22 is made of a soft material, such as silicone, so that the connector 21 has an appropriate hardness to facilitate connection, and the guard 22 can play a cushioning and protection role.

A guide groove 204 for accommodating the guide member 122 therein is formed on an inner wall of the first wall member 201 of the corner guard 20, a key hole 205 for fitting the key 126 is further provided in the guide groove 204, the guard 22 covers the key hole 205 but forms a soft operable operating region 226, and pressing the operating region 226 can drive the key 126 to be displaced inward to release sliding displacement locking of the corner guard 20.

Here, the connector 21 is composed of a first connecting face 211 and a second connecting face 212; the first connecting face 211 is located at the inner surface of the window sash, while the second connecting face 212 is located at the bottom edge and the side edge of the window sash to firmly connect the second connecting face 212 and the first connecting face 211; and two shaft column arms 213 are provided at intervals obliquely above the first connecting face 211, a shaft column cavity 214 is formed between the two shaft column arms 213, and both ends of the shaft column 131 are respectively connected to the shaft column arms 213.

The guard 22 is molded by injection molding and connected with the connector 21, and a plurality of strip-shaped molding portions 215 are further provided on an outer surface of the first connecting face 211, and the molding portions 215 may be a structure which is easy to be molded and connected, such as a strip-shaped concave-convex member, so that the connector 21 and the guard 22 are firmly connected.

The guard 22 has a first guard 221, a second guard 222 and a third guard 223, the first guard 221 is located at the inner surface of the window sash, the second guard 222 is located at the bottom edge and the side edge of the window sash, and the third guard 223 is located at the outer surface of the window sash, so that the first connecting face 211 and the first guard 221 form the first wall member 201, the second connecting face 212 and the second guard 222 form the second wall member 202, and the third guard 223 forms the third wall member 203. Due to the arrangement of the molding portion 215 and the second connecting face 212, the guard 22 is formed with a molding connecting portion 224 and a molding connecting groove 225 after injection molding, and the molding connecting portion 224 is a member with an opposite concave-convex shape to the molding portion 215. For example, the molding portion 215 is a groove and the molding connecting portion 224 is correspondingly a convex member, and the molding connecting groove 225 is a groove-shaped member accommodating the second connecting face 212.

The usage process and working principle of the window corner guard of the present embodiment are as follows.

First, the connector 21 is fixed to the window sash to be protected, for example, 3M adhesive is applied to an inner surface of the base body 11, and then the base body 11 is fitted and fixed to the window sash, ensuring that the corner guard is properly positioned during fitting. During the process, preferably, the window corner guard is remained in the unlocked state to facilitate positioning and adhesive fixing.

Second, in the locked state, the shaft column 131 is in the first pivot position 102 (as shown in FIG. 1), and the first limiting member 123 is engaged with the second limiting member 206 to keep the corner guard 20 in this position/state, at which time the window corner is accommodated in the corner guard cavity 101 for protection, and the window corner guard also prevents the window sash from being locked and closed.

Figure 6:
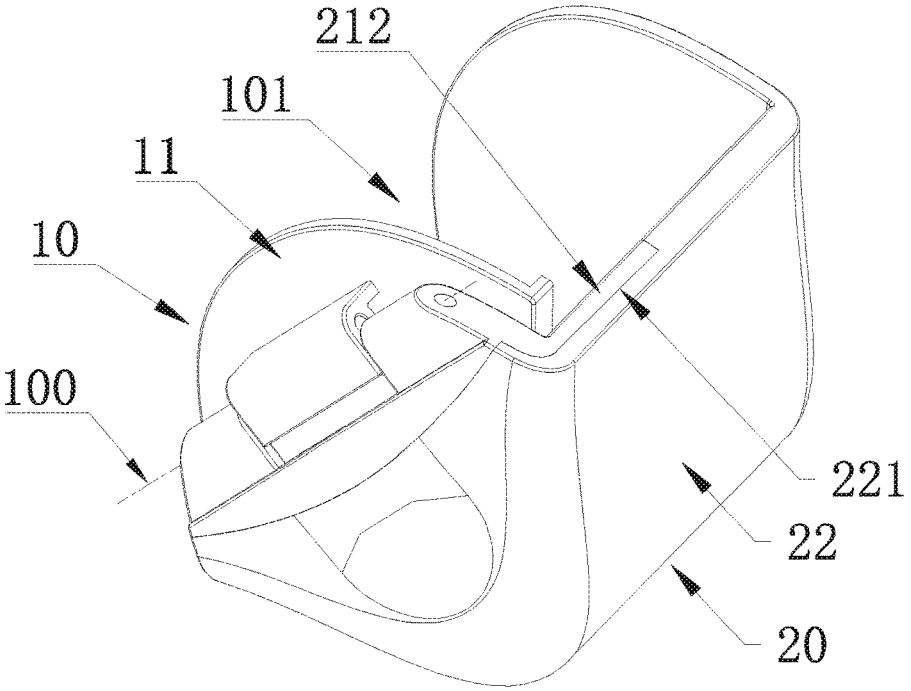
FIG. 6 is a structural schematic diagram of the window corner guard of the embodiment of FIG. 1 in an unlocked state.

Third, if the window corner guard needs to be adjusted to the unlocked state, the corner guard 20 is driven to displace and slide relative to the base 10, so that the shaft column 131 is displaced from the first pivot position 102 to the second pivot position 103 (as shown in FIG. 6), and at the same time, the first limiting member 123 is disengaged from the second limiting member 206, and the corner guard 20 returns to the freely rotatable state relative to the base 10, which allows closing of the window sash, and the window corner guard does not prevent the closing. After the first limiting member 123 is disengaged from the second limiting member 206 to be unlocked, the corner guard 20 may be rotated relative to the base 10 under the action of an elastic member, under the action of its own gravity, or under the resistance of the window frame.

In the unlocked state, if the window corner guard is to be adjusted to the locked state, the corner guard 20 can be rotated relative to the base 10 to fit the first wall member 201 to the base body 11, at this time, the corner guard 20 is at an angle that can protect the window corner, and then the corner guard 20 is pushed and slid relative to the base 10 to displace the shaft column 131 from the second pivot position 103 to the first pivot position 102, and the first limiting member 123 is engaged with the second limiting member 206 to lock the rotation of the corner guard 20.

In the present embodiment, each angle is measured with a horizontal line as a reference, and angle values are relative values, allowing appropriate modification or allowing machining errors within a range that does not affect the basic principle.

In addition, in other embodiments, instead of providing the key 126, the sliding displacement of the corner guard 20 may be limited by means of an interference fit between the first limiting member 123 and the second limiting member 206 or bump limiting, which can achieve the purpose of retaining sliding to a certain extent. However, the limiting is not as firm as the physical locking enabled by the key 126, and a child may exert a force to cause the corner guard 20 to slide, which reduces the safety.

Embodiment 2

A window corner guard has a main structure similar to that of Embodiment 1, except that the locking assembly of the present embodiment is different from Embodiment 1.

The differences are specifically as follows.

First, the shaft column 131 is non-displaceably provided in the shaft hole 132, and the shaft column 131 is only rotatably provided in the shaft hole 132.

Second, the corner guard 20 is only rotatable and cannot be displaced relative to the base 10, and the rotation of the corner guard 20 and the base 10 is locked or unlocked by the locking assembly of the present embodiment.

In the present embodiment, the overall structure of the base 10 and the corner guard 20 is similar to that of Embodiment 1, and will not be described in detail herein.

Here, the shaft hole 132 has a circular cross-sectional shape, and the shaft column 131 is fitted in the shaft hole 132, so that the corner guard 20 is rotatably connected relative to the base 10.

The locking assembly of the present embodiment includes a third limiting member which is reciprocally movably provided on the base 10, and a fourth limiting member is provided on the connector 21 of the corner guard 20, the third limiting member is composed of a sliding block, and a front end thereof is formed as a locking tongue, and the fourth limiting member is composed of a locking cavity into which the locking tongue extends.

When the third limiting member slides so that the locking tongue extends into the locking cavity, the rotation of the corner guard 20 relative to the base 10 is locked, so that the window corner guard is in a locked state. When the third limiting member slides to disengage the locking tongue from the locking cavity, the corner guard 20 restores to be freely rotatable relative to the base 10, so that the window corner guard is in an unlocked state.

Of course, in other embodiments, the third limiting member may also be reciprocally movably provided on the corner member 20, such as on the connector 21, while the fourth limiting member is formed on the base 10.

Embodiment 3

A window corner guard has a main structure similar to that of Embodiment 1, except that the shaft column 131 of the present embodiment is different from Embodiment 1.

The differences are specifically as follows.

First, the present embodiment has two shaft columns 131 which are respectively arranged at both ends of the shaft hole 132, so that the corner guard 20 is rotatably connected relative to the base 10.

Second, the shaft column 131 is telescopically arranged, which serves to lock the sliding movement of the corner guard 20 on the basis of realizing the pivot function.

Figure 7:
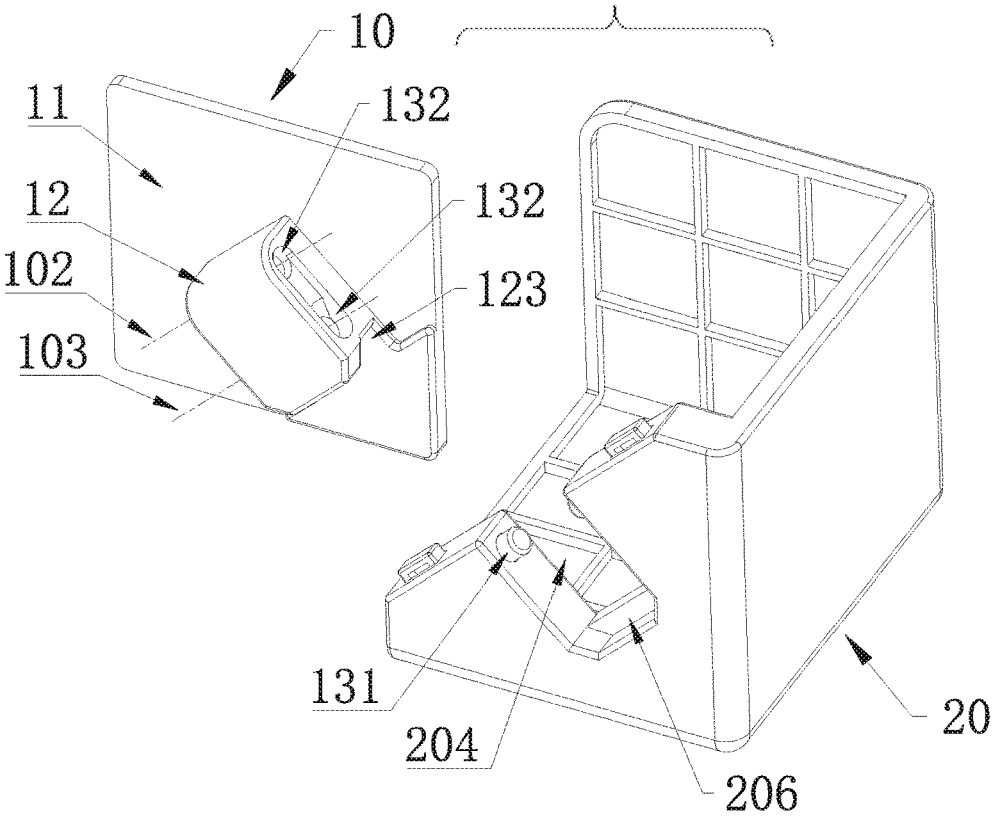
FIG. 7 is a structural exploded view of a window corner guard according to Embodiment 3.
Figure 8:
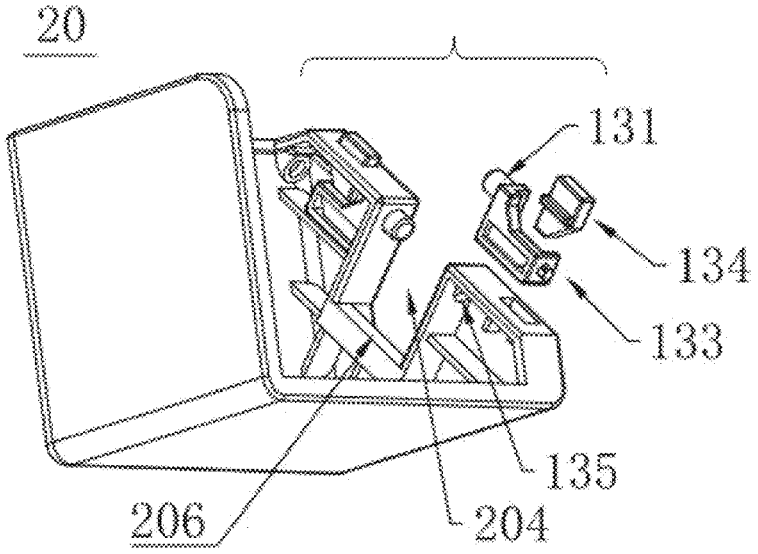
FIG. 8 is a structural exploded view of a corner guard in FIG. 7.

To this end, in the present embodiment, as shown in FIGS. 7-8, the window corner guard further includes a first sliding block 133 and a second sliding block 134, where the first sliding block 133 is reciprocally slidably arranged at both sides of the guide groove 204 in an extending direction of the pivot 100, the shaft column 131 is arranged at one end of the first sliding block 133 and passes through the shaft column hole 135 to extend or retract into the guide groove 204 by the sliding of the first sliding block 133 in the extending direction of the pivot 100, and the second limiting member 206 is provided at a bottom end of the guide groove 204. The second sliding block 134 is movably arranged in a direction perpendicular to a sliding direction of the first sliding block 133, and at least one of the first sliding block 133 and the second sliding block 134 is provided with a guide surface, which may be a plane or a curved surface, to drive the shaft column 131 to extend or retract as the first sliding block 133 slides by pressing the second sliding block 134.

Preferably, a return spring is provided between the first sliding block 133 and the corner guard 20 to keep the shaft column 131 extended when there is no external force.

Two sets of shaft holes 132 are respectively provided at both sides of the connecting seat 12, a first set of shaft holes 132 is correspondingly provided to form a first pivot position 102, a second set of shaft holes 132 is correspondingly arranged to form a second pivot position 103, and the first limiting member 123 is arranged at a bottom end of the connecting seat 12. When the two shaft columns 131 are fitted to the first pivot position 102, the first limiting member 123 and the second limiting member 206 are in a concave-convex fit to lock the rotation of the corner guard 20. When the two shaft columns 131 are fitted to the second pivot position 103, the first limiting member 123 and the second limiting member 206 are disengaged to release the rotation locking and allow the corner guard 20 to rotate. In the process, the second sliding block 134 is pressed to drive the shaft column 131 to retract along with the sliding of the first sliding block 133, so that the shaft column 131 is disengaged from the shaft hole 132 of the first pivot position 102, thus releasing the sliding locking of the corner guard 20, and allowing the corner guard 20 to slide relative to the base 10 so as to displace the shaft column 131 towards the shaft hole 132 of the second pivot position 103.

What is claimed is:

1. A window corner guard, configured to be mounted to a window corner of a window sash to prevent impact injuries, comprising:

a base configured to be fixed to the window sash;

a corner guard configured to protect the window corner, the corner guard being rotatably connected to the base about a pivot as a pivot axis; and a rotary locking assembly comprising a first locking member and a second locking member respectively provided on the base and the corner guard, the first locking member being engaged with or disengaged from the second locking member to form a locked state or an unlocked state; and wherein in the locked state, rotation of the corner guard relative to the base is locked to cover and protect the window corner; and in the unlocked state, the corner guard is rotatable relative to the base.

2. The window corner guard according to claim 1, wherein one of the base and the corner guard is provided with a shaft hole and the other is provided with a shaft column, the shaft hole extends in a first direction perpendicular to a length direction of the shaft hole to form a shaft hole in elongated shape, and a first pivot position and a second pivot position are formed in the shaft hole;

a first limiting member and a second limiting member are provided on the base and the corner guard respectively; when the shaft column is in the first pivot position, the first limiting member is engaged with the second limiting member to lock the rotation of the corner guard; and when the corner guard slides to cause the shaft column to be in the second pivot position, the first limiting member is disengaged from the second limiting member to unlock the rotation of the corner guard.

3. The window corner guard according to claim 2, further comprising a sliding locking mechanism, wherein the sliding locking mechanism comprises a movably provided key and a key hole configured to fit the key, and the key and the key hole are respectively arranged on the base and the corner guard.

4. The window corner guard according to claim 3, wherein the first limiting member and the second limiting member are respectively a concave member and a convex member in a concave-convex fit to lock the rotation of the corner guard; and the shaft column is an integral shaft member and arranged in the shaft hole in a penetrating manner, or the shaft column is a split shaft member and inserted into both ends of the shaft hole.

5. The window corner guard according to claim 2, wherein the first limiting member and the second limiting member are in interference fit; or the first limiting member and the second limiting member are in a positioning fit through a bump limiting mechanism; or the base and the corner guard are in interference fit.

6. The window corner guard according to claim 2, wherein the corner guard comprises a first wall member and a second wall member, the first wall member is pivotally connected to the base, and the second wall member is located outside a bottom edge and a side edge of the window corner in the locked state.

7. The window corner guard according to claim 6, wherein the corner guard comprises a connector and a guard, the guard is made of a cushioning material and connected with the connector or is integrally injection-molded with the connector, and the connector is made of a hard material; and the pivot is arranged at a 45° angle relative to a bottom edge of the window sash.

8. A window corner protection method, for protecting a window corner of a window sash to prevent impact injuries, comprising:

providing a window corner guard comprising a base and a corner guard; one of a shaft column and a shaft hole being provided on the base, the other being provided on the corner guard, and the shaft column being arranged in the shaft hole in a penetrating manner; a size of the shaft hole in a first direction perpendicular to a length direction of the shaft column being greater than a size of the shaft column, and a first pivot position and a second pivot position arranged at a predetermined distance apart being formed in the first direction; and a rotary locking assembly acting between the base and the corner guard to lock or unlock rotation of the corner guard;

fixing the base to a surface of the window sash near the window corner;

to protect the window corner, rotating the corner guard to cover the window corner, and then displacing the corner guard in the first direction to displace the shaft column to the first pivot position, and the rotary locking assembly locking the rotation of the corner guard to be kept locked; and to release the protection, reversely displacing the corner guard in the first direction to displace the shaft column from the first pivot position to the second pivot position, unlocking the rotary locking assembly, and restoring the corner guard to be rotatable to form an unlocked state.

9. A window corner guard, configured to be mounted to a window corner of a window sash to prevent impact injuries, comprising:

a base configured to be fixed to the window sash near the window corner; and a corner guard capable of covering the window corner and being locked for rotation by a rotary locking assembly to prevent impact injuries, and also capable of unlocking the rotary locking assembly to transition to a freely rotatable state;

wherein, the corner guard is pivotably connected to the base by a shaft column, and is formed with a first pivot position and a second pivot position, the corner guard is also movably displaced relative to the base along a first direction perpendicular to a direction in which the shaft column extends, and the second pivot position is spaced apart by a predetermined distance in the first direction relative to the first pivot position;

when the shaft column is in the first pivot position, the rotary locking assembly locks the rotation of the corner guard to form a locked state;

the corner guard is driven to movably displace in the first direction so that the shaft column is displaced from the first pivot position to the second pivot position, and the rotary locking assembly is unlocked to transition to the freely rotatable unlocked state.

10. The window corner guard according to claim 9, wherein the corner guard is movably arranged parallel to a surface of the window sash, and a direction of outward displacement thereof is the first direction.

11. The window corner guard according to claim 10, wherein one of the corner guard and the base is provided with the shaft column and the other is provided with a shaft hole, a size of the shaft hole in the first direction is greater than a size of the shaft column, and the shaft column is arranged in the shaft hole in a penetrating manner to displace between the first pivot position and the second pivot position.

12. The window corner guard according to claim 10, wherein the corner guard is kept in the locked condition by magnetic attraction or an interference fit between the corner guard and the base.

13. The window corner guard according to claim 10, wherein the shaft column is arranged at a 45° angle relative to a bottom edge of the window sash, the corner guard is movably displaced along a 135° angle direction, the corner guard comprises a connector and a guard, the connector is made of a hard material, and the guard is made of a cushioning material and connected with the connector or integrally injection-molded with the connector.

14. The window corner guard according to claim 10, wherein the window corner guard further comprises a displacement locking assembly, the displacement locking assembly comprises a key movably provided perpendicular to the surface of the window sash, the key locks displacement movement of the corner guard when the key is located in both the corner guard and the base, and unlock the displacement when the key is disengaged from one of the corner guard and the base.

15. The window corner guard according to claim 14, wherein one of the corner guard and the base is provided with a first limiting member and the other is provided with a second limiting member, and the first limiting member and the second limiting member are respectively a concave member and a convex member.

* * * * *